United States Patent [19]

Bellot et al.

[11] 4,395,064

[45] Jul. 26, 1983

[54] ELECTRIC AUTOMOBILE TRUNK LOCK MECHANISM

[75] Inventors: Dominique Bellot, Rueil; Michel Barré, Chaville, both of France

[73] Assignee: Regie Nationale des Usines Renault, Boulogne-Billancourt, France

[21] Appl. No.: 253,909

[22] Filed: Apr. 14, 1981

[30] Foreign Application Priority Data

Apr. 14, 1980 [FR] France ..... 80 08259

[51] Int. Cl.[3] ..... E05C 3/26

[52] U.S. Cl. ..... 292/201; 292/336.3

[58] Field of Search ..... 74/427; 292/201, 216, 292/280, 336.3, 217, 223

[56] References Cited

U.S. PATENT DOCUMENTS

| | | | |
|---|---|---|---|
| 2,325,225 | 7/1943 | Burke | 292/201 X |
| 3,566,703 | 3/1971 | Van Noord | 292/201 X |
| 4,093,289 | 6/1978 | Anabayashi et al. | 292/201 X |

*Primary Examiner*—Richard E. Moore

*Attorney, Agent, or Firm*—Oblon, Fisher, Spivak, McClelland & Maier

[57] ABSTRACT

An electrical lock mechanism for servo locking and unlocking the trunk lid or hatch lid of an automobile by means of a motorized bolt engaging a catch to close the door is disclosed. The lid supports a fixed catch and the body of the vehicle supports a compact motor unit comprising an electric motor, controlled from a distance by impulses and capable of sequentially pivoting a rotating bolt and its blocking lever. The motor is connected to the bolt and lever by two disengageable link rods.

6 Claims, 6 Drawing Figures

ELECTRIC AUTOMOBILE TRUNK LOCK MECHANISM

BACKGROUND OF THE INVENTION

1. Field of the Invention

The present invention relates to an automatically locking and unlocking electric lock for the trunk or hatch lid of an automobile.

2. Description of the Prior Art

Known devices use either a motorized catch or a motorized latch to activate the lock. Such a motorized catch is disposed, for example, on the body of the vehicle and is connected to the motor, while the bolt is located on the striking edge of the door or hatch lid.

To secure the lock in its locked position it is necessary to lock the bolt with a blocking lever, activated separately by an electro-magnet. This necessitates a second motor unit and poses problems due to supplementary cables needed to supply the door, which is articulated to the vehicle body. In addition, the catch electrically locks only after the bolt is previously engaged, such as when the door is manually shut but before the weather stripping is compressed.

Other simpler devices are only able to electrically unlock the bolt, thus unlocking the catch to open the door is done manually, as well as locking it when the door is closed. Also, in the case of an electrical circuit malfunction, it is not always possible to intervene in the mechanical manual back-up control.

SUMMARY OF THE INVENTION

The object of the present invention is to overcome the disadvantages of the prior art and to provide an entirely electrically controlled locking and unlocking mechanism using a single motor unit disposed on the vehicle body and backed up by a classical mechanical control which makes it possible to continue using the lock in the classic manner in case the electrical installation fails.

The automated device has enough force to release the lock from the catch after blocking the bolt when closed, as soon as the striking of the door has been completed and before the weather stripping has been compressed, thus providing, in the process, a remarkably gentle operation while eliminating manual interlocking of the bolt.

To this end the invention has as an object an electric lock mechanism of the type described above, in which the striker edge of the door supports the fixed catch and the body supports the compact motor unit comprising a remote impulse control electric motor capable of pivoting a rotary bolt sequentially, along with its associated blocking lever, by means of two link rods activated by the motor output shaft acting as a crankshaft. This automatically and successively provides for a half turn of the motor output shaft, the locking of the catch and the blocking of the bolt when the door is being closed, then the blocking and unlocking when the door is opened in the course of the following half turn in the same motor rotation direction.

The motor uses conductive leads to initiate a half turn for each electrical control impulse corresponding to two stationary stop positions, respectively, lock and unlock.

The electrical impulses can be supllied from either inside or outside the vehicle; on the one hand the impulses originate from a contact which detects the correct presentation of the catch after the door is closed, and on the other hand the impulses originate from a contact activated by manipulating a control lock outside the door.

Moreover, a bar connects the opening control lock outside the door to the blocking lever to provide for manual unlocking of the lock in case the electrical circuit fails.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
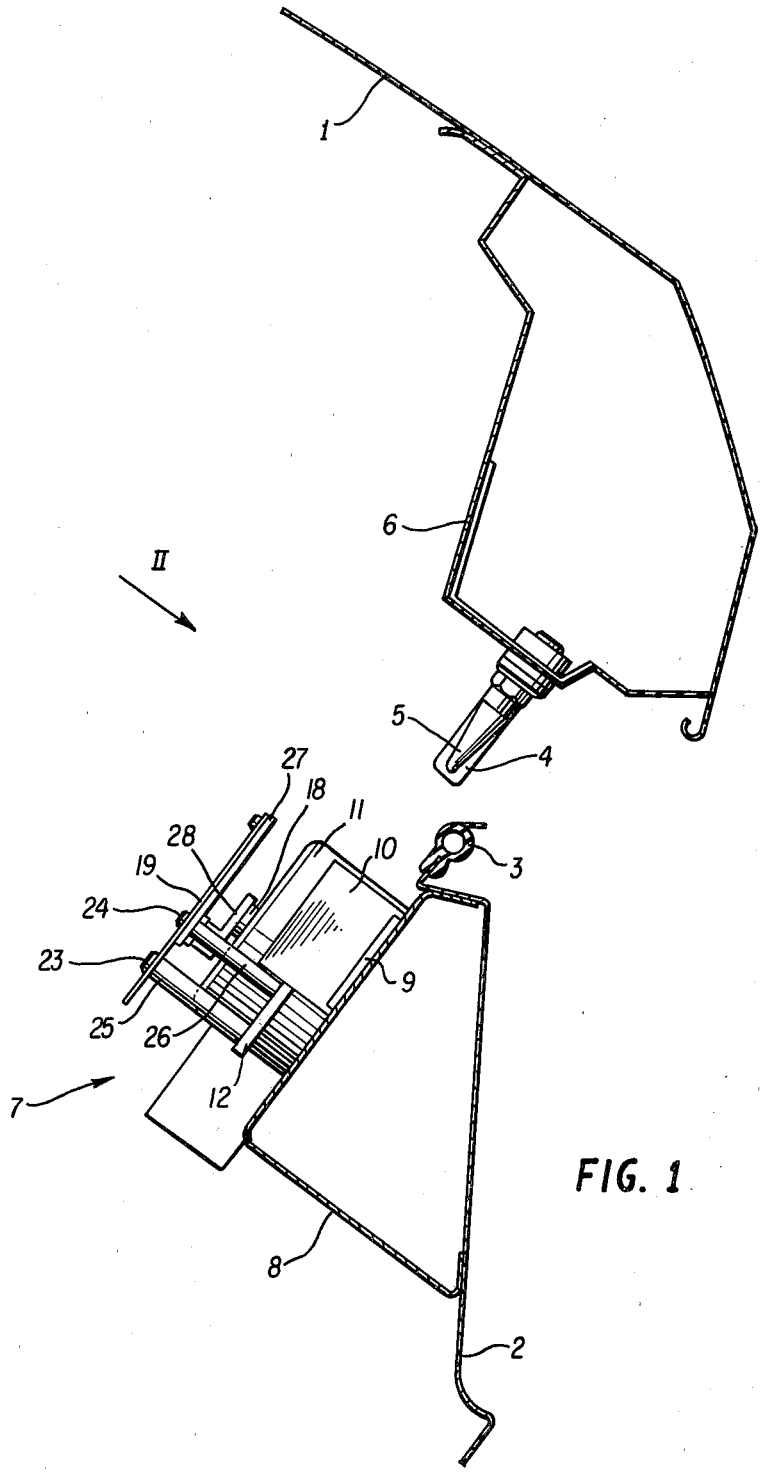
FIG. 1 shows, in section seen along line I of FIG. 2, the position of the lock elements in the fixed and mobile parts of the body.
Figure 2:
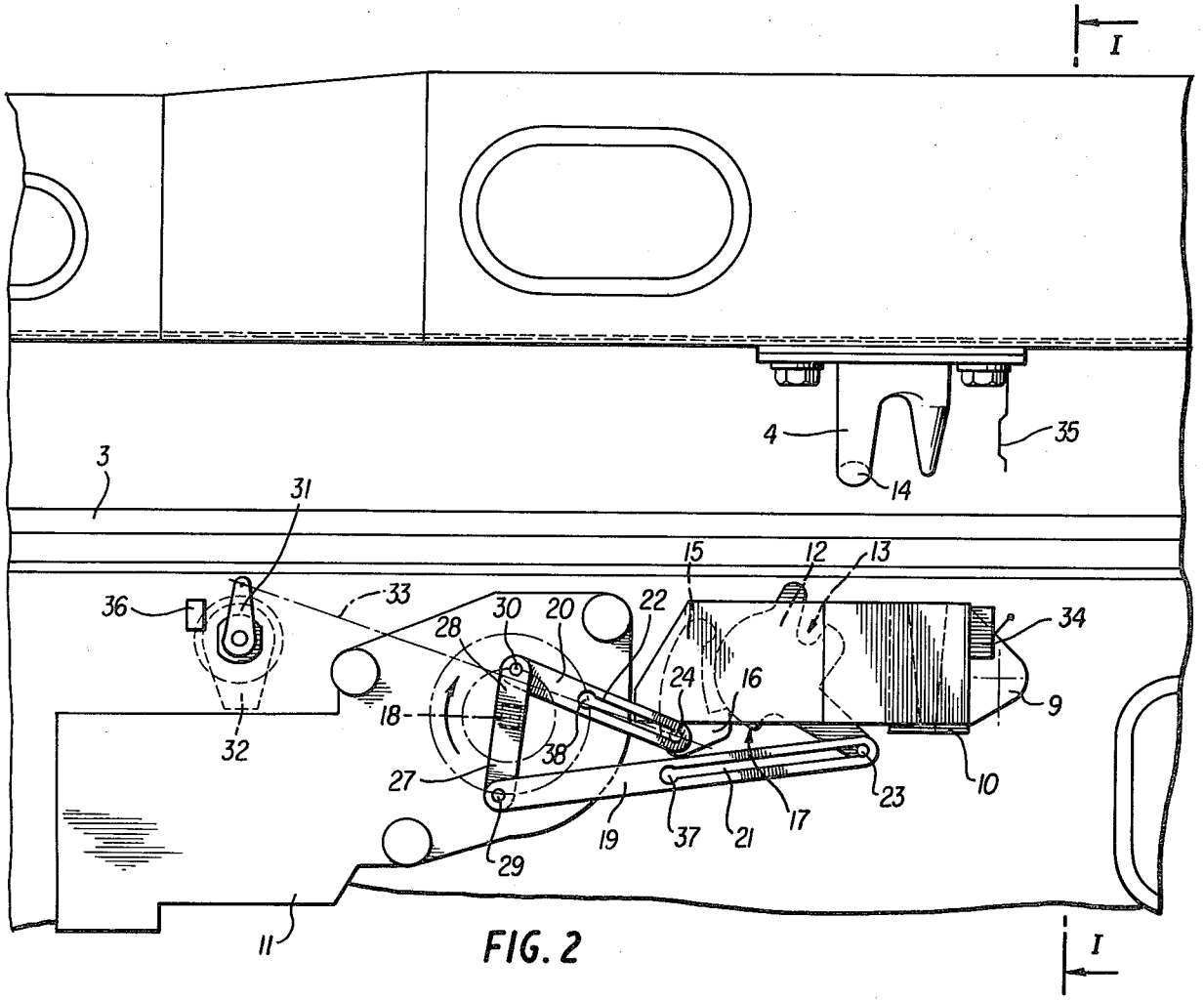
FIG. 2 is a view of the vehicle interior in the direction of arrow II in FIG. 1.

FIGS. 1 and 2 show the rear part of an automobile including the trunk lid or a hatch lid 1, which after pushing down a weather strip 3, is capable of being locked to the fixed body 2, thus defining the trunk.

The stirrup or yoke type catch 4 of the lock is provided with a centering cone 5, and is mounted to the box beam or girder 6 of the box forming the posterior part of the door, while the motorized unit 7 of the electric lock is fixed to the interior of the trunk, or a second box beam 8 forming the rear sidewall of the vehicle, by way of a plate 9 which also supports the complementary piece 10 for the centering cone and the various components of the motorized assembly, namely: an electric motor 11 equipped with a speed reduction device and supplied by means of several conductive leads (not shown in the figures but forming an integral part of the motor block as shown), and a rotating bolt 12 with a fork 13 to anchor and lock the catch stirrup 14. Further, the bolt can be blocked by a pivoting blocking lever 15, i.e. the block, operates as a ratchet 16 on the exterior edge of the rotating ratchet bolt 12.

The bolt 12 and its blocking lever 15 are respectively acted upon by two return springs (not shown) of such a type that the bolt tends to return automatically to its opening or catch release position, shown in FIG. 2, while the blocking lever is constantly held against the cam surface 17 on the exterior edge of the bolt 12.

The bolt 12 and the block lever 15 are respectively connected to the motor drive shaft 18 by way of two link rods 19 and 20, respectively perforated by slides 21 and 22 which permit the sliding motion of the respective bolt and lever retainer pins 23 and 24 when the link rods are not being driven.

As can be seen in FIG. 1, the retainer pins 23 and 24 are respectively connected to the bolt 12 and to the blocking lever 15 by means of two spacers 25 and 26 which laterally transfer the movement of the link rods.

The other ends of the link rods are articulated on two superimposed cranks 27, 28, schematically shown in FIG. 2 as a single bar connecting the joints 29 and 30 of the lock link rod 19 and the blocking link rod 20. These cranks are eccentric to the motor drive shaft 18 thus giving the link rods the movements of a crankshaft, and transforming the continuous circular movement thereof into alternating, rectilinear movement.

Further, the blockiing lever 15 is connected to the output lever 31 of the control lock 32. This control lock controls the exterior opening of the trunk by way of a bar 33 (shown as a broken line). Thus, it is possible to manually activate the blocking lever 15 and free the bolt 12 if the electrical circuit fails.

A first contact 34, fixed to the body and disposed in the proximity of the bolt 12, detects the position of the catch 4 as soon as it arrives adjacent the circular trajectory of the bolt fork 13, by means of a release cam fixed to the door as shown at 35 in FIG. 2. One can also use a failure contact. The contact 34 sends an impulse to the electric motor 11 to control the locking and blocking of the lock.

A second contact 36 is fixed on the trajectory of lever 31 of the outside opening control lock to send a suitable impulse to the motor control to unblock and unlock the bolt 12 to open the door.

Figure 5:
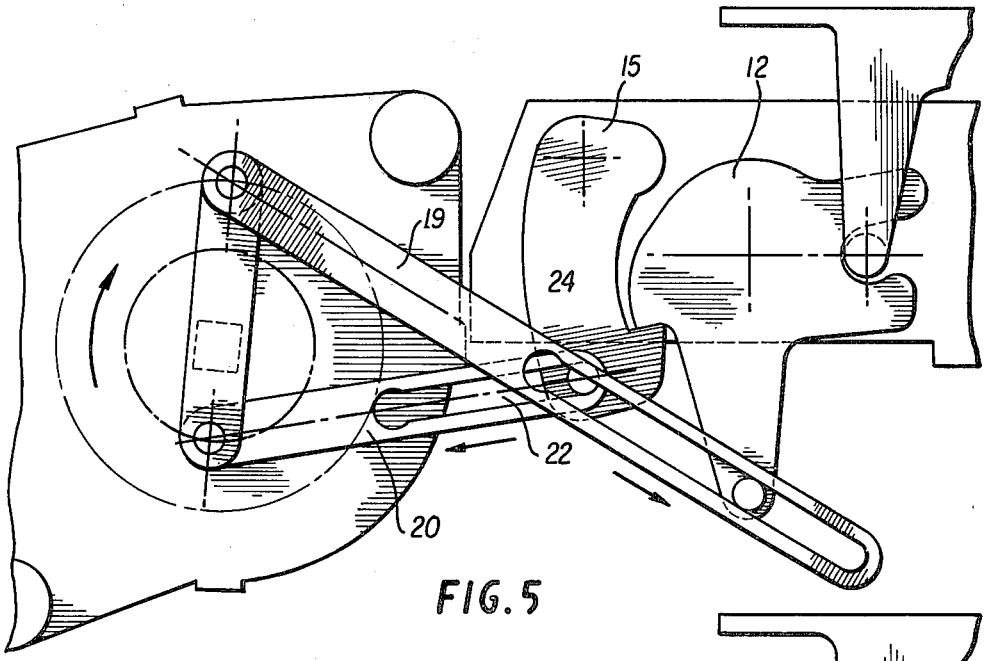

More particularly, the link rod positions chosen in FIG. 1 correspond to those of FIG. 5, i.e. the door is closed and locked, through FIG. 1 shows the door open.

Figure 3:
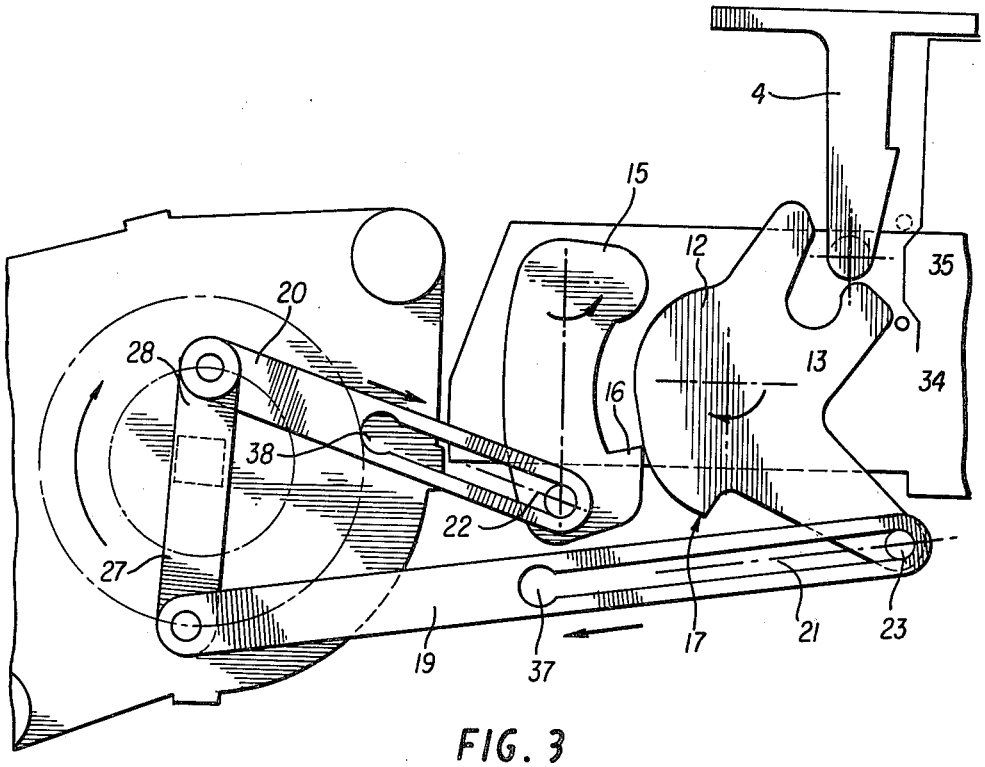
FIGS. 3 through 6 illustrate different operation phases of the locking and blocking mechanism.

The electric lock according to the invention operates in the following manner with reference to FIGS. 3 to 6:

When the door is open, the parts of the mechanism are located in the positions shown in FIG. 3.

Figure 4:
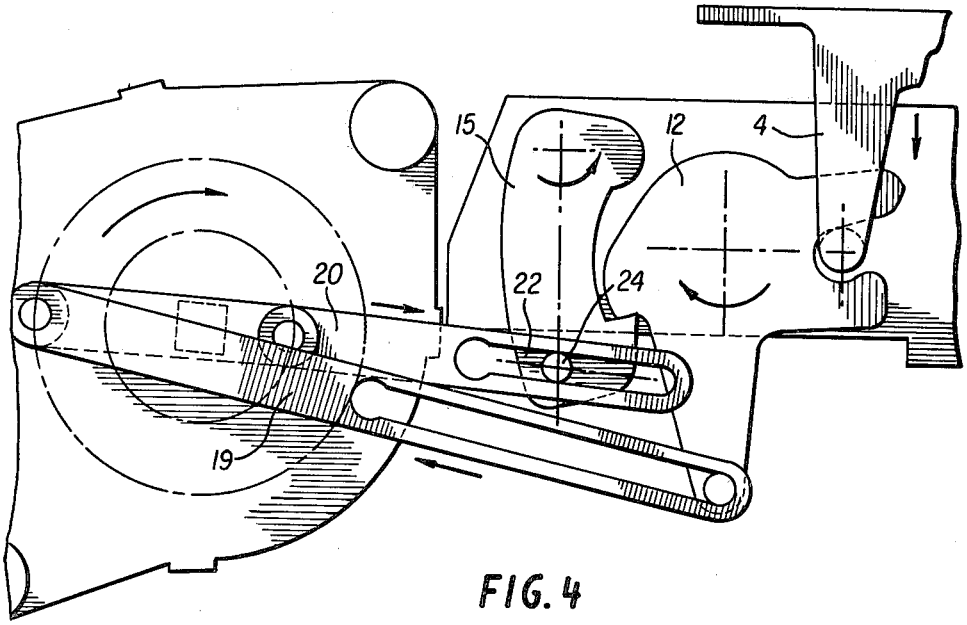

When the user lowers the trunk or hatch lid without slamming it, the lid moves the catch 4 into the trajectory of the bolt fork 13 even before the weather stripping on the trunk is compressed. This position is detected by the contact 34 which sends an electrical impulse to the motor. The manual closing action is thus relayed by motor assist to the lock. By means of appropriate conductive leads the motor executes a half turn, leaves the position in FIG. 3 and assumes the position in FIG. 5. The two figures correspond to the two motor stop positions; FIG. 4 shows a transitional position.

As shown in FIG. 3, the first quarter turn of the motor pivots the bolt 12 in the clockwise direction, via the link rod 19, thus causing the catch 4 to lock while simultaneously compressing the weather stripping. The blocking lever 15, biased by its spring, slides on the bolt cam 17 until the stop 16 blocks the bolt 12. The movement of the lever 15 is permitted by the slide 22 of the blocking link rod 20 which is thus inoperative. The position in FIG. 4 thus corresponds to the locking of catch 4 and the blocking of bolt 12.

However, the motor continues its course another quarter turn to bring the link rods into the positions in FIG. 5 where they are immobilized. This figure also shows the lock mechanism locked and blocked, but now the lock is prepared for reopening by the following impulse, because the retaining pin 24 of the blocking lever 15 is located at the end of the slide 22.

Figure 6:
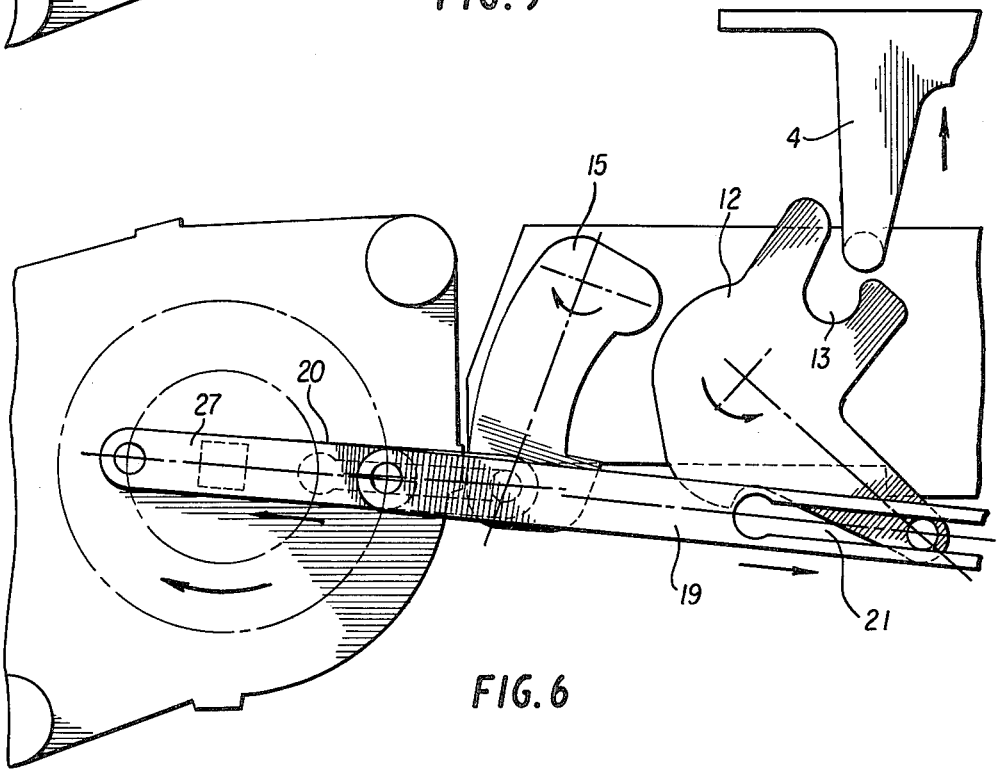

When another impulse is sent either from inside the vehicle by a contact disposed, for example, on the dash board, or by the release contact 36 activated from outside, and initiated by control lock 32, to open the trunk, the motor executes another half turn in the same direction to bring the link rods from the positions shown in FIG. 5 into those in FIG. 3 via FIG. 6.

As soon as the motor rotates to a position beyond that shown in FIG. 5, the blocking link rod 20 pivots the lever 15, correspondingly freeing the bolt 12 which rotates counterclockwise via its return spring. The movement of the bolt is permitted by the existence of the slide 21 on the blocking link rod 19 and by the displacement of the latter toward the right in FIG. 6. As can be seen, the catch 4 is then disengaged and freed from fork 13, aided by the expansion of the weather stripping.

The passage to the stop position of FIG. 3 brings the blocking lever 15 back into contact with the cam surface 17 of bolt 12, while the retaining pin 23 of the bolt moves to the end of its slide 21, due to the movement of the link rods 20 and 19. As with FIG. 6, FIG. 3 thus corresponds to a condition unlocking the lock, but in FIG. 3 the lock is prepared for reclosing with a new impulse in accordance with the cycle described above.

As has been seen, the electrical operation is backed up by a mechanical secondary system activated by an exterior opening control lock 32. In addition, the lock can operate mechanically in the classic manner to open and close the door by slamming.

Thus it is possible to disconnect the motorization by uncoupling the blocking link rods 19 and 20, by releasing the retainer pins 23 and 24 through the circular openings 37, 38 respectively at the ends of the slides 21 and 22.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electric lock mechanism for the servo locking and unlocking of a vehicle hatch lid, comprising a fixed catch mounted on said hatch lid and a compact motor unit mounted on the body of said vehicle, wherein said compact motor unit comprises:

an electric motor having a shaft;

a rotary bolt engagable with said catch;

a blocking lever adapted to block said bolt in a locked position;

crankshaft means connected to said motor shaft;

first and second links respectively connecting said crankshaft means to said bolt and said blocking lever; and means for rotating said electric motor shaft by half turn intervals in a first direction;

whereby each half turn of said motor shaft alternately locks and blocks said lock, and unlocks and unblocks said lock.

2. The mechanism of claim 1, including:

a plate mounted to said body upon which said bolt and blocking lever are rotatably mounted;

return springs biasing said bolt and blocking lever in first rotary positions;

first and second pins respectively mounted on said bolt and blocking lever, first and second slides respectively formed in said first and second links, said first and second pins being respectively slidably positioned in said first and second slides, wherein said crankshaft means comprise first and second cranks having distal ends circumferentially spaced by 180°, said ends being respectively pivotally connected to the ends of said first and second links.

3. The mechanism of claim 1 wherein said means for rotating comprises an electric impulse generating means including a contact positioned adjacent said bolt such that said contact detects said catch when said catch reaches a position on the rotational trajectory of the fork of said bolt.

4. The mechanism of claim 1 wherein said means for rotating comprises an electric impulse generating means including a contact positioned to be activated by the movement of an exterior control.

5. The mechanims of claim 1 including a third link connecting an exterior control to said blocking lever for rotation of said blocking lever.

6. The mechanism of claim 2 wherein said pins have enlarged ends and said slides have enlarged portions, whereby said pins may be disengaged from said slides only at said enlarged portions.

* * * * *